US012638009B2

(12) United States Patent
Mueller et al.

(10) Patent No.: US 12,638,009 B2
(45) Date of Patent: May 26, 2026

(54) RADIAL PISTON PUMP, AND PROCESS FOR MANUFACTURING A RADIAL PISTON PUMP

(71) Applicants: thyssenkrupp Dynamic Components GmbH, Ilsenburg (DE); thyssenkrupp AG, Essen (DE)

(72) Inventors: Ulf Mueller, Chemnitz (DE); Tim Mueller, Chemnitz (DE)

(73) Assignees: thyssenkrupp Dynamic Components GmbH, Ilsenburg (DE); thyssenkrupp AG, Essen (DE)

( * ) Notice: Subject to any disclaimer, the term of this patent is extended or adjusted under 35 U.S.C. 154(b) by 21 days.

(21) Appl. No.: 18/289,362

(22) PCT Filed: Apr. 29, 2022

(86) PCT No.: PCT/EP2022/061481
§ 371 (c)(1),
(2) Date: Nov. 2, 2023

(87) PCT Pub. No.: WO2022/238148
PCT Pub. Date: Nov. 17, 2022

(65) Prior Publication Data

US 2024/0240623 A1 Jul. 18, 2024

(30) Foreign Application Priority Data

May 10, 2021 (DE) ..... 10 2021 204 713.0

(51) Int. Cl.
*F04B 1/0404* (2020.01)
*F04B 1/0421* (2020.01)
*F04B 17/03* (2006.01)

(52) U.S. Cl.
CPC ..... *F04B 1/0421* (2013.01); *F04B 17/03* (2013.01); *F04B 1/0404* (2013.01)

(58) Field of Classification Search
CPC ..... F04B 1/0421; F04B 1/04; F04B 1/0404
See application file for complete search history.

(56) References Cited

U.S. PATENT DOCUMENTS 2,621,607 A * 12/1952 Trapp ..... F04B 1/0426 417/490
3,784,331 A 1/1974 Heidorn
(Continued)

FOREIGN PATENT DOCUMENTS

CN 102439312 A 5/2012
DE 2852852 B1 6/1980
(Continued)

OTHER PUBLICATIONS

English Translation of International Search Report issued in PCT/EP2022/061481, dated Jul. 20, 2022.

*Primary Examiner* — Thomas Fink
(74) *Attorney, Agent, or Firm* — thyssenkrupp North America, LLC

(57) ABSTRACT

A radial piston pump, including a drive shaft having an eccentric and at least one piston-and-working chamber combination, wherein the piston-and-working chamber combination includes a working chamber and a piston. The radial piston pump includes at least two piston-and-working chamber combinations which extend radially from the drive shaft, wherein each working chamber is closed by a cover. The radial piston pump is equipped with at least one retaining ring for fixing all of the covers of the radial piston pump; and to a method for producing a radial piston pump.

23 Claims, 7 Drawing Sheets

(56) References Cited

U.S. PATENT DOCUMENTS

| | | | | |
|---|---|---|---|---|
| 10,677,356 | B2 * | 6/2020 | Fujita | F04B 39/12 |
| 2001/0048880 | A1 * | 12/2001 | Herrmann | F04B 1/0452 417/470 |
| 2012/0111185 | A1 | 5/2012 | Stephenson et al. | |
| 2013/0167957 | A1 * | 7/2013 | Rajput | F04B 1/0426 137/565.11 |

FOREIGN PATENT DOCUMENTS

| | | | |
|---|---|---|---|
| DE | 10 2010 064 084 | A1 | 6/2012 |
| EP | 0520286 | A2 | 12/1992 |
| EP | 0522116 | A1 | 1/1993 |

* cited by examiner

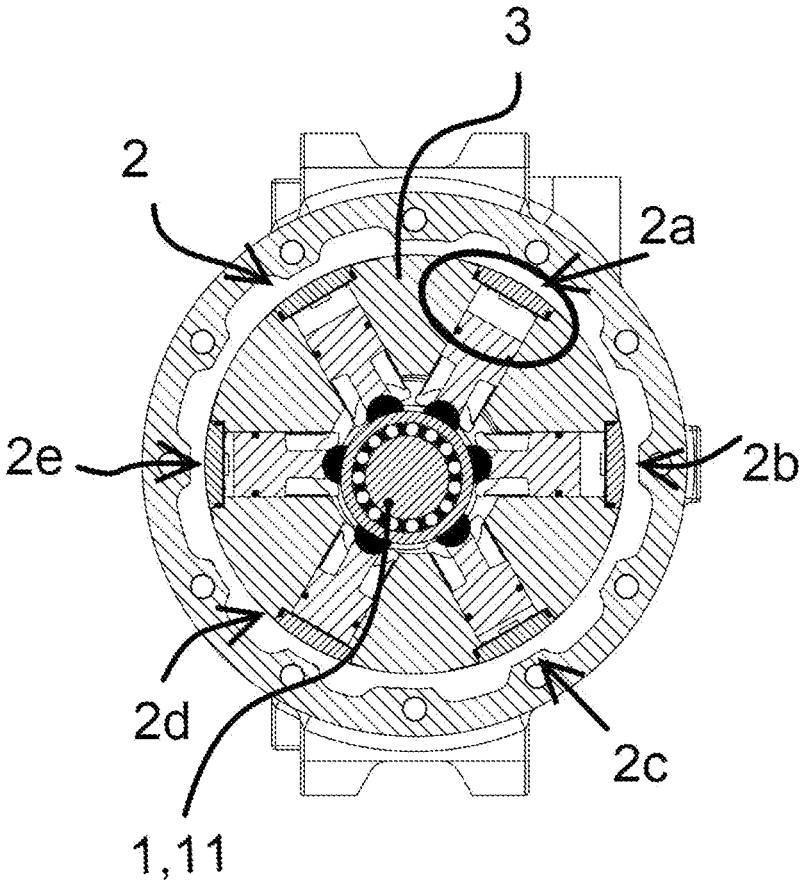
Fig. 1
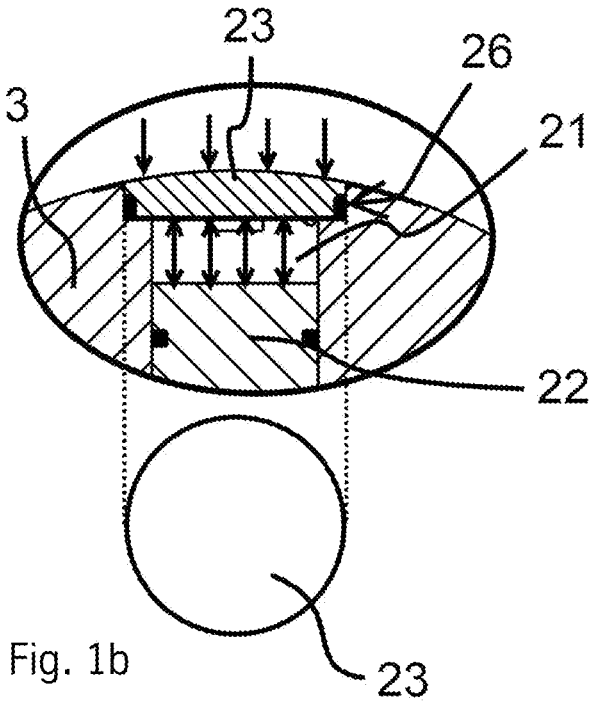
Fig. 1a
Fig. 1b

Fig.2
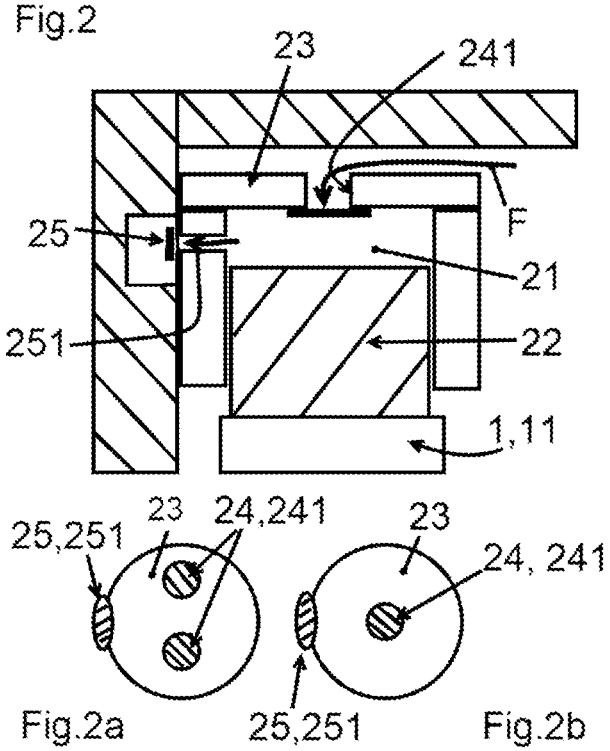
Fig.2a Fig.2b
Fig.3
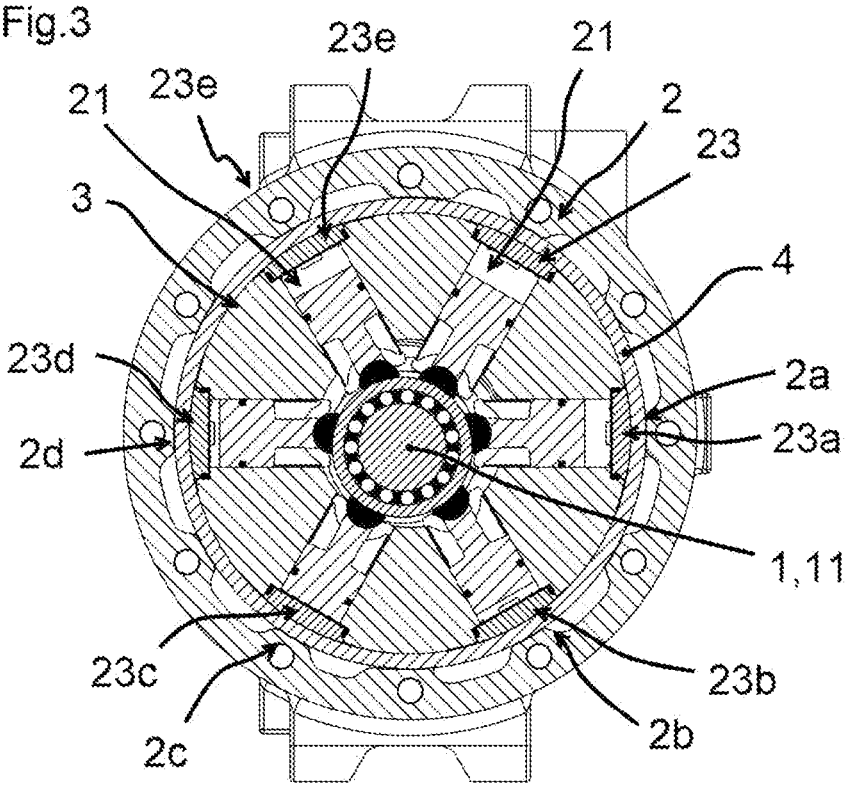

RADIAL PISTON PUMP, AND PROCESS FOR MANUFACTURING A RADIAL PISTON PUMP

CROSS REFERENCE TO RELATED APPLICATIONS

This application is a U.S. National Stage Entry of International Patent Application Serial Number PCT/EP2022/061481, filed Apr. 29, 2022, which claims priority to German Patent Application No. DE 10 2021 204 713.0, filed May 10, 2021, the entire contents of which are incorporated herein by reference.

FIELD

The present disclosure generally relates to a radial piston pump, in particular radial piston compressor.

BACKGROUND

A radial piston pump is an element in fluidics. In this pump, also referred to as a pump based on the principle of a radial piston, the piston-and-working chamber combinations are disposed radially and perpendicularly to the drive shaft—as opposed to an axial piston compressor. The delivery or stroke movement of each individual working piston is caused by an eccentric which is situated on the drive shaft. The radial piston pump typically comprises a plurality of piston-and-working chamber combinations which extend radially, in a star-shaped manner, from the drive shaft. The radial piston pump pumps a fluid from a low-pressure chamber into a high-pressure chamber.

Radial piston pumps are used, for example, as compressors for coolant in air-conditioning systems of motor vehicles, in particular also in electrically driven motor vehicles. A radial piston pump may also be referred to as a radial piston compressor, or a refrigerant compressor operating according to the radial piston principle.

The present disclosure relates to improving a radial piston pump, in particular a refrigerant compressor operating according to the radial piston principle, the stroke function thereof being transmitted to the pistons by means of a circular eccentric. The valves for the gas exchange procedure in a radial piston pump of this type are preferably disposed as follows. The inlet valves are disposed radially in terms of the rotation axis of the eccentric shaft, i.e. close to the head-end of the respective piston. In contrast, the outlet valves are preferably disposed axially, which offers advantages in terms of the installation space an also offers more freedom in terms of the design of the inlet valves, in particular a larger valve diameter, a larger bending length, potentially more inlet valves, etc.

A radial piston pump furthermore comprises a cover. The cover is embodied, for example, as a pre-assembled module and besides the cover comprises a seal, an inlet valve plate having a reed valve and two fastening pins which hold the module together. The inlet valve, in particular the valve plate having a reed valve, preferably lies in the base of a machined cylindrical recess above the working chamber on the pump main body. The cover, preferably by way of the seal, presses externally on the valve plate, against the rim of the machined cylindrical recess. When the piston moves from the upper terminal position to the lower terminal position, negative pressure is created in the working chamber between the piston head and the cover, and the inlet valve opens into the working chamber and fresh gas is inducted. Once the bottom dead center (BDC) of the piston has been reached, the piston moves upward again, the inlet valve closes, and the fluid, in particular gas, situated in the working chamber is compressed. In the case of CO2-compressors, the pressure in the working chamber increases up to 140 bar, for example. The low-pressure region, the pressure level thereof being approx. 35 bar, is above the cover. This means that the cover, in particular including the inlet valve, is pushed outward radially beyond the face of the cover by a pressure differential of 140-35 bar.

The compressive force created has to be absorbed by a suitable cover fastening. According to the prior art, the cover is fastened using screws, for example, i.e. one threaded cover connection is provided for each cylinder unit. The threaded connection causes additional radial installation space and additional costs in terms of parts and assembling.

The present disclosure proceeds from there and is based on providing an improved radial piston pump; in particular, the intention is to provide a radial piston pump which is easier and/or quicker to assemble.

According to the disclosure, this is achieved by a radial piston pump being equipped with at least one retaining ring for fixing all of the covers of the radial piston pump. The resultant advantages lie in particular in that only one component which handles the retaining force of the covers is required. Accordingly, this results in a reduction in the number of components and/or a simplification of the components. A further potential advantage lies in that cost-intensive machining such as drilling and tapping, and additional assembly steps such as, for example, fitting screws for each cylinder, are dispensed with. A reduction in terms of production costs is derived in particular.

In one advantageous design embodiment of the disclosure it can be provided that the radial piston pump comprises at least three, preferably six, piston-and-working chamber combinations which are disposed in a star-shaped manner about the drive shaft. Accordingly, a plurality of piston-and-working chamber combinations can be driven by means of one drive shaft, in particular eccentric shaft.

In one further advantageous design embodiment of the disclosure it can be provided that the piston-and-working chamber combinations are received in a pump main body. A correspondingly compact construction mode of the radial piston pump can be implemented as a result.

In one further advantageous design embodiment of the disclosure it can be provided that the cover has a contact face for the retaining ring. A defined contact face can be appropriately adapted to the internal face of the retaining ring, in particular with a view to a suitable curvature and an appropriate adaptation to the diameter of the retaining ring so that an advantageous form-fit or a sufficient interference fit can be achieved, for example.

In one further advantageous design embodiment of the disclosure it can be provided that the cover and/or the pump main body have/has a resting rim for the retaining ring, wherein the resting rim has in particular a radially extending face as a detent for the retaining ring. The resting rim can serve as a detent for the retaining ring, for example as a corresponding detent during the assembly of the retaining ring, on the one hand. Furthermore, when the retaining ring bears completely on the resting rim, it can be ensured that the cover or covers is/are in the correct angular position, for example.

In one further advantageous design embodiment of the disclosure it can be provided that the radial piston pump has at least two retaining rings for fixing all of the covers of the radial piston pump, wherein the retaining rings are disposed axially behind one another. It is in principle preferably provided that the fixing of the covers is performed by a single retaining ring. However, a larger number of intakes, or inlet valves, or a particular arrangement of an intake, or inlet valve, may be provided as required, so that it may be advantageous for the retaining rings to be disposed about the inlet valve openings.

In one further advantageous design embodiment of the disclosure it can be provided that an interference fit is provided between the retaining ring and the cover.

In one further advantageous design embodiment of the disclosure it can be provided that the internal diameter of the retaining ring has an internal diameter according to tolerance class IT7 or IT8.

In one further advantageous design embodiment of the disclosure it can be provided that the radial piston pump is equipped with a housing which is specified to receive at least in portions the pump main body, in particular the piston-and-working chamber combinations.

In one further advantageous design embodiment of the disclosure it can be provided that the housing of the radial piston pump is configured from at least two housing components, in particular a high-pressure housing and/or a stator housing, in particular for receiving a rotor and a stator of an electric motor.

In one further advantageous design embodiment of the disclosure it can be provided that the retaining ring is integrated in the housing or at least one housing component.

In one further advantageous design embodiment of the disclosure it can be provided that the housing components are screwed to one another, in particular in that the housing components are screwed conjointly by means of a screw.

In one further advantageous design embodiment of the disclosure it can be provided that the pump main body has a flange which serves for screw-fitting to the housing and/or the further housing components.

In one further advantageous design embodiment of the disclosure it can be provided that the housing components configure fluid ducts of the radial piston pump, or at least sub-regions thereof.

In one further advantageous design embodiment of the disclosure it can be provided that the housing component has plane-parallel axial sealing faces.

In one further advantageous design embodiment of the disclosure it can be provided that the surfaces of the sealing faces of the housing component are equipped with concentric grooves, in particular with a corrugation in the radial direction.

In one further advantageous design embodiment of the disclosure it can be provided that seals are disposed additionally or solely between the sealing faces.

In one further advantageous design embodiment of the disclosure it can be provided that the surfaces of the sealing faces have one or a plurality of geometric shapes which deviate from a planar or almost planar face.

In one further advantageous design embodiment of the disclosure it can be provided that fluctuations in the mutual spacing of the housing components can be compensated for by the elasticity.

BRIEF DESCRIPTION OF THE FIGURES

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 1 shows a radial piston pump, without a retaining ring, in a sectional view.

FIG. 1*a* shows an enlarged illustration of a sub-region of a radial piston pump according to FIG. 1.

FIG. 1*b* is shows a top view of a cover of a radial piston pump for highlighting the face of the former.

FIG. 2 shows a diagram of a piston-and-working chamber combination of a radial piston pump for highlighting the functional mode of the former.

FIG. 2*a* shows arrangements of inlet valve(s) and outlet valve(s) of a piston-and-working chamber combination of a radial piston pump.

FIG. 2*b* shows arrangements of inlet valve(s) and outlet valve(s) of a piston-and-working chamber combination of a radial piston pump.

FIG. 3 shows a radial piston pump according to the disclosure in a sectional view.

DETAILED DESCRIPTION

Figure 4:
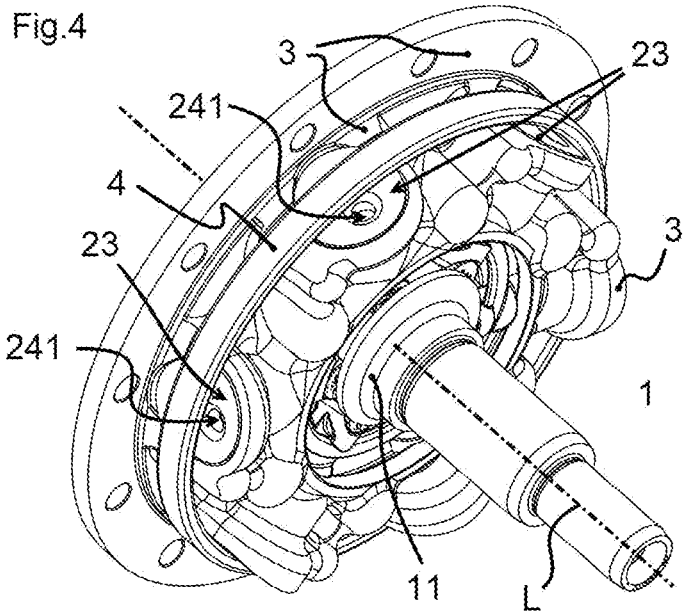
FIG. 4 shows a radial piston pump according to the disclosure is a perspective view.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The following reference signs are used in the images:

L Longitudinal axis

F Fluid

W Tool

WHZ Heatable tool

S Welding tool
1 Drive shaft
2 (*a-e*) Piston-and-working chamber combination
3 Pump main body
4 (*a*) Retaining ring
5 Resting rim
6 Housing
7 High-pressure housing
8 Stator housing
11 Eccentric
21 Working chamber
22 Piston
23(*a-e*) Cover
24 Inlet valve
25 Outlet valve
26 Seal
27 Flange
28 Screw
41 Slit
251 Fluid outlet
252 High-pressure duct
241 Fluid inlet
232 Contact face Features and details herein which are described in the context of a method of course also apply to the device according to the invention and vice versa, so that reference is always made, or may be made, in a reciprocating manner between the disclosures pertaining to the individual aspects of the invention. Moreover, a method according to the invention potentially referred to can be carried out by the device according to the invention.

The terminology used herein serves merely the purpose of description of certain embodiments and is not intended to restrict the disclosure. As used herein, the singular forms "a/an" and "the" are also intended to comprise the plural forms if the context does not clearly show something else. In addition, it will become clear that the expressions "has" and/or "having", when used in this description, specify the presence of the indicated features, integers, steps, operations, elements and/or components, but do not rule out the presence or the addition of one or more other features, integers, steps, operations, elements, components and/or groups. As used herein, the expression "and/or" comprises every arbitrary element and all combinations of one or more of the associated, listed elements.

Reference is first made to FIG. 1, or 1*a*, respectively.

A radial piston pump comprises substantially a drive shaft 1 having an eccentric 11, and at least one piston-and-working chamber combination 2 which is received in a pump main body 3. A longitudinal axis L of the drive shaft 1 is plotted in FIG. 1 to define the axial direction. The piston-and-working chamber combination 2 comprises substantially a working chamber 21 and a piston 22. The working chamber 21 at the piston head-end is closed by a cover 23.

The radial piston pump typically comprises at least two piston-and-working chamber combinations 2, 2*a*, 2*b*, . . . , which extend radially from the drive shaft 1. The radial piston pump preferably comprises at least three, preferably six, piston-and-working chamber combinations 2, 2*a*, 2*b* . . . , which correspondingly extend in a star-shaped manner from the drive shaft 1. Accordingly, each piston-and-working chamber combination 2, 2*a*, 2*b*, . . . , is provided with a cover 23, 23*a*, . . . . The piston-and-working chamber combinations 2, 2*a*, 2*b*, . . . can be received in a housing 6.

Furthermore, a fluid inlet 241 is provided in the cover 23, or at the head-end of the working chamber 21, respectively. A fluid outlet 251 is also provided in the working chamber 21, preferably in the wall of the working chamber 21. The fluid inlet 241 is equipped with an inlet valve 24 which can selectively close or release the fluid inlet 241. The fluid outlet 251 is provided with an outlet valve 25 which can selectively close or release the fluid outlet 251.

Figure 10:
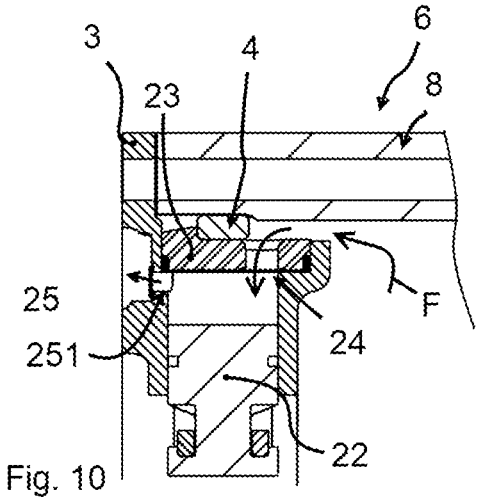
FIG. 10 shows a schematic illustration of the fluidic flow in a sub-region of a radial piston pump.

As is illustrated in FIG. 10, for example, the fluid F to be compressed, by way of the fluid inlet 241, or the inlet valve 24, flows into the working chamber 21, in the latter is compressed by the stroke movement of the piston 22, and exits the working chamber 21 through the outlet valve 25, or the fluid outlet 251. The design embodiment of the valves, for example as a spring-plate valve, is sufficiently well known to the person skilled in the art and does not require any further explanation here.

FIG. 1*a* visualizes the prevailing system pressures and the participating pressure faces of the cover 23 which is disposed radially in relation to the drive shaft 1. The cover 23 furthermore comprises a seal 26. The inlet valve 24, in particular comprising a valve plate with a reed valve, bears on the base of a machined cylindrical recess above the working chamber on the pump main body 3. The cover 23 pushes externally on the valve plate, pushing the latter against the rim of the machined cylindrical recess. When the piston moves from the upper terminal position to the lower terminal position, negative pressure is created in the working chamber between the piston head and the cover 23, and the inlet valve 24 opens into the working chamber, and fresh gas is inducted. Once the bottom dead center (BDC) of the piston has been reached, the piston 22 moves upward again, the inlet valve closes, and the gas situated in the working chamber is compressed. The compressed gas exits the working chamber 21 in an analogous manner through the fluid outlet 251 or the outlet valve 25.

FIG. 2 shows a diagram of a piston-and-working chamber combination of a radial piston pump for highlighting the functional mode of the former; illustrated in particular here is the fluidic flow from the fluid inlet 241 by way of the working chamber 21 into the fluid outlet 251.

A variant of a piston-and-working chamber combination 2 having two fluid inlets 251, or two inlet valves 24, and one fluid outlet 241, or outlet valve 25, is illustrated in FIG. 2*a*, and a variant of a piston-and-working chamber combination 2 having a fluid inlet 241, or an inlet valve, and a fluid outlet 251, or an outlet valve 25, is illustrated in FIG. 2*b*.

The design embodiment of the further components and the functional mode of a radial piston pump, such as the valves, for example, which can be designed as spring plate valves, for example, is sufficiently well known to the person skilled in the art and does not require any further explanation here.

It is provided according to the invention that the radial piston pump is equipped with at least one, preferably one, retaining ring 4 for fixing all of the covers 23, 23*a* to 23*e* of the radial piston pump. In other words, it is provided in particular that the covers 23 (*a-e*) of all piston-and-working chamber combinations 2 (*a-e*) are fixed simultaneously by means of only one common retaining ring 4. This is shown in particular in FIGS. 3 and 4, using the example of a 6-cylinder radial piston compressor. In this way, the retaining ring 4 generates the retaining force necessary for holding all covers 23 in position in relation to the working chamber 21, or the pump main body 3, under operating conditions.

Figure 6:
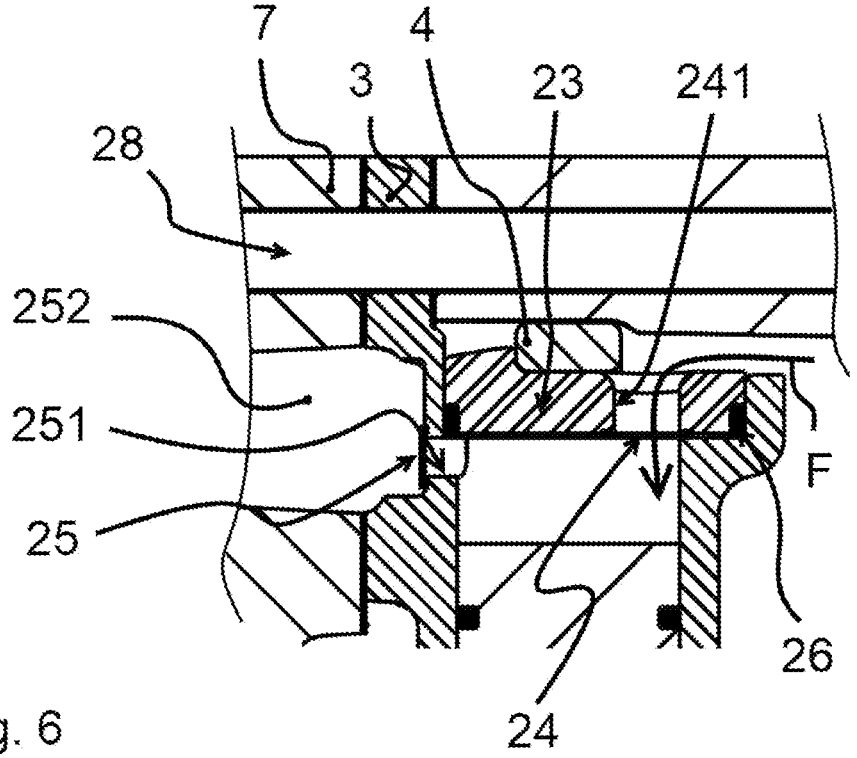
FIG. 6 shows a yet again enlarged illustration of a sub-region according to FIG. 5.
Figure 7:
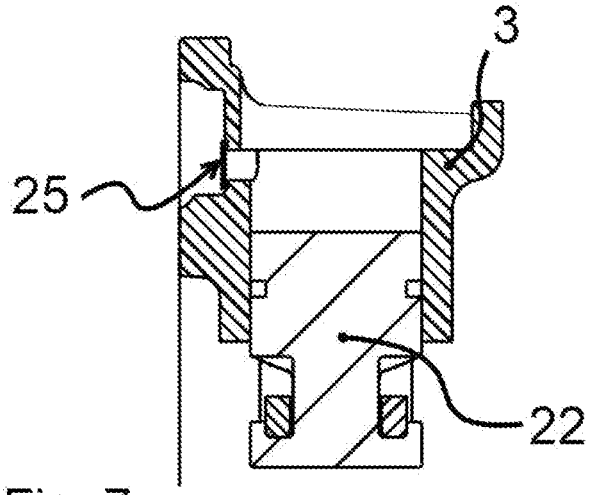
FIGS. 7-9 show an enlarged illustration of a sub-region of a radial piston pump according to the disclosure, for highlighting assembly steps.
Figure 8:
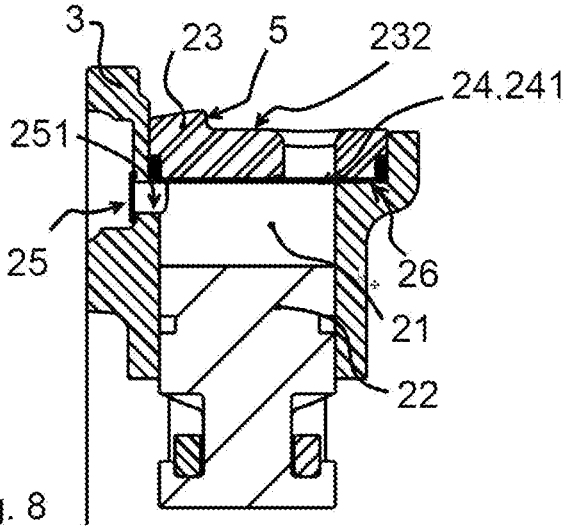
Figure 8A:
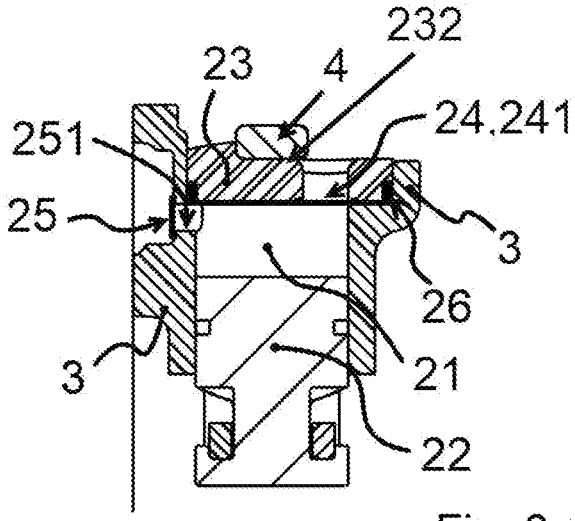
Figure 9:
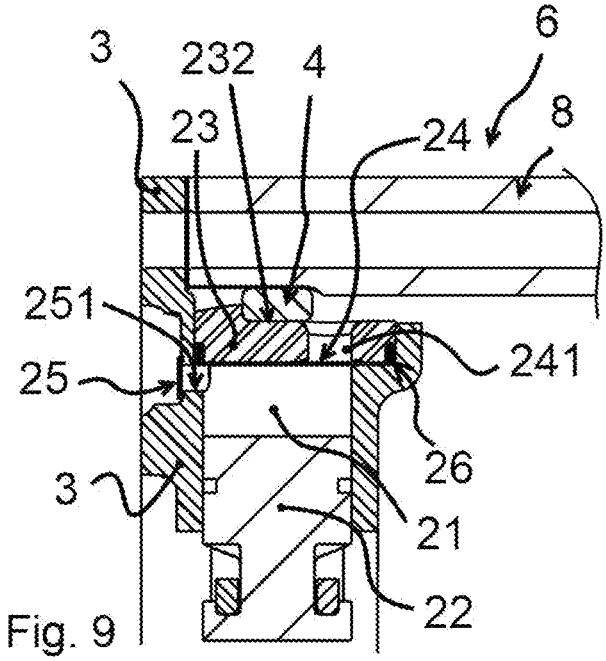

It can furthermore preferably be provided that the cover 23 and/or the pump main body 3 have/has a resting rim 5 for the retaining ring 4. A resting rim 5 of this type can be readily seen in FIG. 6, for example, and is in particular designed as a radially aligned face. The axial position of the retaining ring 4 on the pump main body 3 and/or the cover 23 can be ensured by the resting rim 5. When assembling the retaining ring 4, the angular position of the cover 23 in relation to the pump main body 3 is preferably simultaneously fixed by the resting rim 5 on the cover 23.

Furthermore, the cover 23 can be equipped with a contact face 232 for the retaining ring 4. The retaining ring 4 can bear in a form-fitting manner on a contact face 232 of this type. In particular the combination of the resting rim 5 and the contact face 232 can guide or ensure the position of the retaining ring 4 on the cover 23 relative to the latter, as well as in terms of the angular position, or the concentricity, of said retaining ring 4 in relation to the longitudinal axis of the pump, for example in the joined state or else even during assembling.

In order for the retaining ring 4 to counteract any potential movement of the cover from the pump main body 3 toward the outside, in particular as a consequence of the pressure ratios, the pairing between all covers 23 and the retaining ring 4 is to be imparted an interference fit. That is to say that the external diameter of all contact points of the contact faces 232 should be larger than the internal diameter of the retaining ring 4 at the same temperature. This interference by overlap—similar to a pre-loaded spring—leads to the retaining ring 4 fixing the cover 23 in relation to the pump main body 3 by way of a defined retaining force, preferably by a defined interference by overlap of the internal diameter of the retaining ring in relation to the contact faces of the cover, which ensures a sufficient retaining force of the cover 23 in relation to the pump main body 3 at all operating points.

Figure 5:
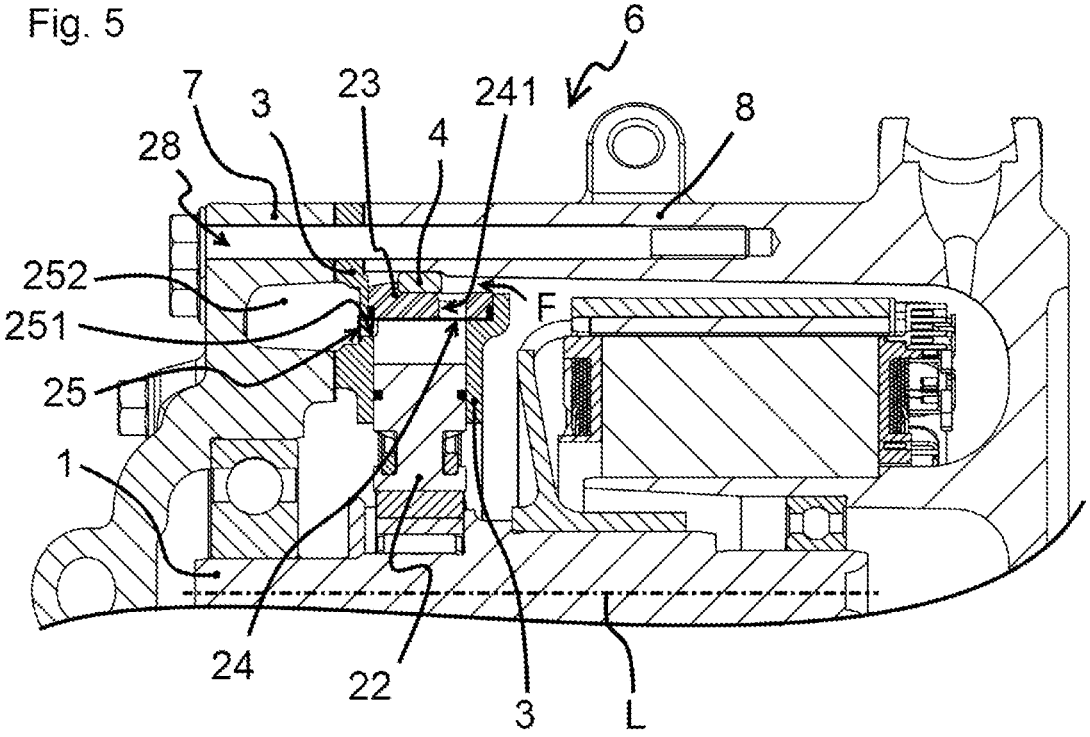
FIG. 5 shows an enlarged illustration of a sub-region of a radial piston pump according to the disclosure.

FIG. 5 shows an enlarged illustration of a sub-region of a radial piston pump according to the invention.

As is illustrated in FIG. 5, in one further advantageous design embodiment of the invention it can be provided that the radial piston pump is equipped with a housing 6 which is specified to receive at least in portions the pump main body 3, in particular the piston-and-working chamber combinations 2, 2*a*, 2*b*, . . . . It can furthermore preferably be provided that the housing 6 of the radial piston pump is configured from at least two housing components, in particular a high-pressure housing 7 and/or a stator housing 8, in particular for receiving a rotor and a stator of an electric motor. It can furthermore preferably be provided that the retaining ring 4 is integrated in the housing 6 or at least one housing component 7, 8. It is provided in principle that the housing component with the integrated retaining ring and the further housing components form the housing of the radial piston pump. As is furthermore illustrated, it can be provided that the housing components are screwed to one another so as to form the pump housing. The housing components are preferably screwed conjointly by means of a screw 28. To this end, it can be provided that the pump main body 3 has a flange 27 or the like, which serves for screwing to the further housing components.

Fluid ducts of the radial piston pump, or at least sub-regions thereof, can preferably be configured by means of the housing parts that are screwed to one another. Such an assembled duct is, for example, the high-pressure duct 252.

The housing components can delimit or seal different pressure ranges within the radial piston pump or in relation to the outside. In a further advantageous design embodiment of the invention it can be provided that the housing component has plane-parallel axial sealing faces. A tight connection to the neighboring housing component, such as the high-pressure housing 7 or the stator housing 8, for example, can be provided by sealing faces of a design of this type.

In one further advantageous design embodiment of the invention it can be provided that the surfaces of the sealing faces of the housing component are equipped with concentric grooves, in particular with a corrugation in the radial direction. The sealing effect can be further improved by the concentric groove or grooves.

It can furthermore be provided that seals are disposed additionally or solely between the sealing faces.

In one further advantageous design embodiment of the invention it can be provided that the surfaces of the sealing faces have one or a plurality of geometric shapes which deviate from a planar or almost planar face. In this way, it can be provided that the sealing faces have a concave or convex shape so as to configure contact faces or linear contacts in a targeted manner.

In this way, a planar sealing face of a housing component can be brought to bear on the convex surface of another housing component, for example, and thus be brought to configure a sealing face. A defined linear contact between the two surfaces is advantageously configured by way of contact between a planar and a convex surface. Such a linear contact can preferably entirely or at least partially represent the function of a seal between corresponding components. One of the surfaces can advantageously have an elastic behavior so that fluctuations in the mutual spacing of components can be compensated for by the elasticity.

Die FIG. 6 shows a yet again enlarged illustration of a sub-region according to FIG. 5.

It can furthermore preferably be provided that the retaining ring 4 has a precision-machined internal diameter. The internal diameter of the retaining ring 4 should preferably be in the tolerance classes IT7 . . . 8.

Furthermore, tight tolerances should be adhered to for the height of the cover 23, in particular with a view to the resting face of the cover in relation to the pump main body, and/or the contact face 232 of the cover 23 in relation to the retaining ring 4.

An adequate pressure resistance should preferably be chosen for the materials on which the contact pressure is created, in particular at the critical contact between cover and retaining ring.

Further details of the invention are derived in particular from a description of the assembly of a radial piston pump according to the invention, in particular with a view toward assembling the retaining ring 4. It is to be understood that only a few selected assembly steps are illustrated here, as are helpful for understanding the method according to the invention. The production of the radial piston pump may comprise further steps, or intermediate steps, which are known to the person skilled in the art.

Fixing of the retaining ring 4 can be performed for example by a thermal-shrinkage transverse interference fit between the covers 23 and the retaining ring 4.

Figure 11:
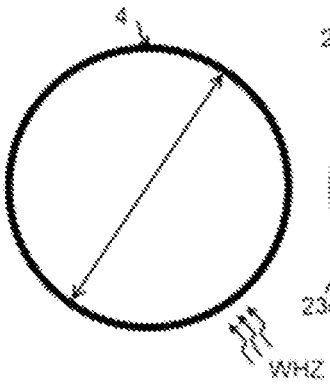
FIGS. 11-13 show a schematic illustration of an assembly variant.
Figure 12:
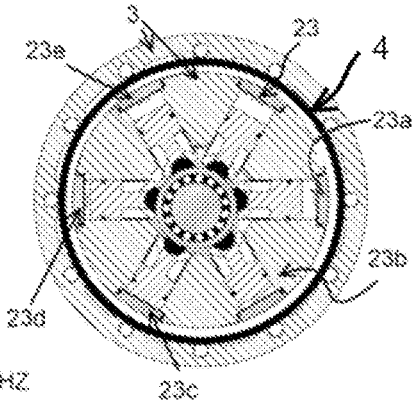
Figure 13:
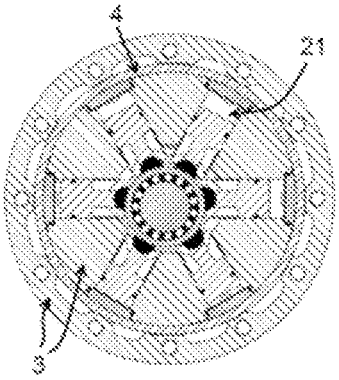

Heating of the retaining ring 4 is performed by means of a heat source, or a heatable tool WHZ, prior to assembly. As a result of the thermal expansion of the retaining ring 4, any overlap between the retaining ring 4 and the cover 23 is eliminated so as to be able to join in the absence of force. Radial play is formed between the resting face of the retaining ring 4 and the contact faces 232 of the covers 23 in the heated state, and the retaining ring 4 can be joined in the absence of almost any force. The retaining ring 4 cools down after assembly, and the overlap is re-created, or a joint pressure acting on all covers 23 is generated by virtue of the shrinkage of the diameter. The minimum joint pressure established in particular at each contact between cover and retaining ring in the process should be so high that the cover 23 is not lifted from the pump main body 3 at the maximum pressure differential between high pressure and low pressure. Such a method is schematically illustrated in FIGS. 11 to 13. While assembling the retaining ring 4, the retaining ring 4 can be brought to rest or stop on the resting rim 5.

Figure 14:
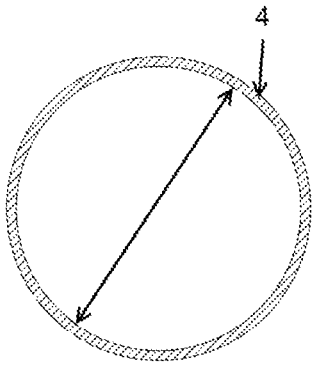
FIGS. 14-15 show a schematic illustration of an assembly variant.
Figure 15:
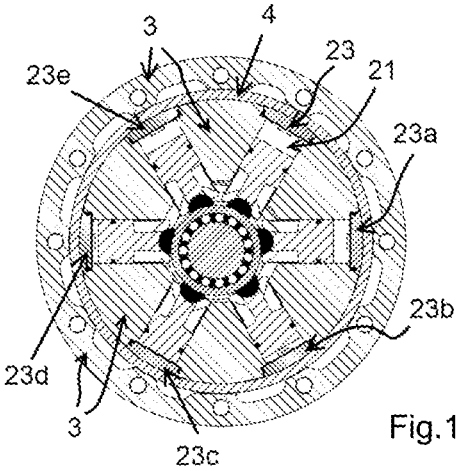

Fixing of the retaining ring 4 can be performed by a longitudinal interference fit between the covers 23 and the retaining ring 4, for example. The retaining ring 4 is pushed onto the cover 23 with an overlap. The retaining ring 4 expands elastically. The overlap generates a force. A method of this type is schematically illustrated in FIGS. 14 and 15. When pushing the retaining ring 4 onto the cover 23, the retaining ring 4 can also be brought to rest or stop on the resting rim 5.

Figure 16:
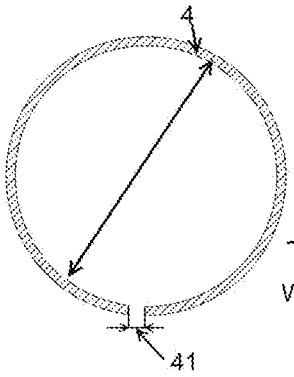
FIGS. 16-18 show a schematic illustration of an assembly variant.
Figure 17:
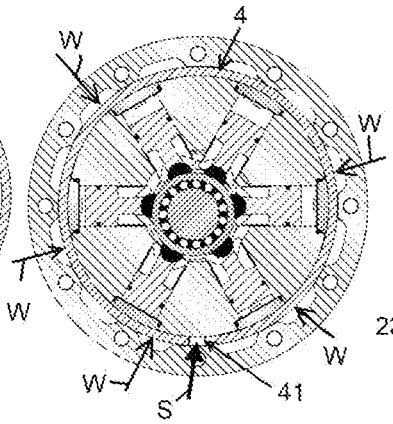
Figure 18:
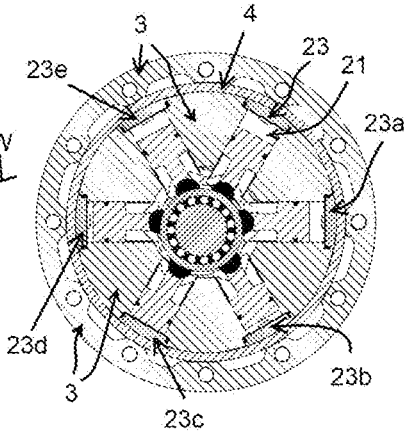

Fixing of the retaining ring 4 can also be performed by a welded connection, for example. The retaining ring 4 is preferably provided once with a slit 41, or is designed as an open ring, and is fitted over the covers 23, then tensioned or compressed by means of a tool W, so that the retaining ring rests on the cover 23 at all contact faces. In this state, the gap of the ring ends is approx. 2 mm in size. The welding process then takes place by means of a welding apparatus S which closes the slitted retaining ring (approx. 2 mm gap) by adding a welding additive, in particular liquid metal. After the welding procedure has been performed, the welding additive cools down, shrinks accordingly, and thus generates a tension in the retaining ring 4. In this variant, the requirements in terms of accuracy set for the retaining ring 4, or the covers 23, may be lower. A method of this type is schematically illustrated in FIGS. 16 to 18. When assembling the retaining ring 4, the retaining ring 4 can be brought to rest or stop on the resting rim 5.

In principle, it is however also conceivable (not shown) that the covers, prior to joining the retaining ring, by means of a device/tool W are elastically pressed (radially) "inward", so as to provide a gap in the joint for the retaining ring for the duration of the joining procedure. If no gap is configured, the overlap during assembling can at least be somewhat reduced. The advantage herein is that the thermal-shrinkage transverse interference fit could be dispensed with in this way (costs, temperature effect in the retaining ring, or effect on the structure of the latter). Moreover, the pushing-on/joining force can be reduced in comparison to the "normal" longitudinal interference fit, or the longitudinal interference fit described above.

The method in principle:

For this purpose, it is necessary that the cover is able to be elastically resilient and/or to elastically yield (dashed lines) in order to configure a gap in the joint (at least in the region of the contact face 232). This can be achieved geometrically by the cover 23, or the geometric design of the latter.

Shown (schematically) in the figure: a tool W presses or elastically deforms the cover 23, the contact face 232 in particular yielding elastically/radially inward, so that a gap is configured or the overlap between the retaining ring and the cover 23 is reduced. After the tool has been removed, the cover 23, or the contact face 232, springs back elastically so that an overlap is configured. Other geometric design embodiments for the cover than those previously shown are preferably to be chosen so that the tool does not get in the way when joining the retaining ring 4, and the contact face 232 can nevertheless be reliably elastically deformed.

In principle (not shown), the elastic behavior can also be achieved by an element which is disposed between the cover and the pump housing/cylinder housing. The tightness must be guaranteed herein, and it must thus be guaranteed that the cover is not lifted.

Figure 19:
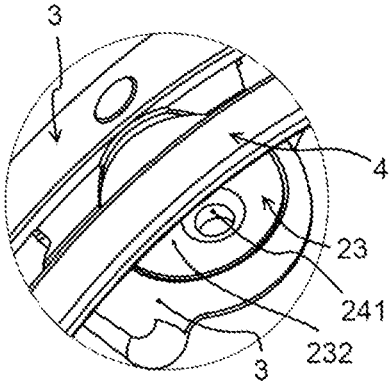
FIG. 19 shows a retaining ring in a potential assembly position.
Figure 20:
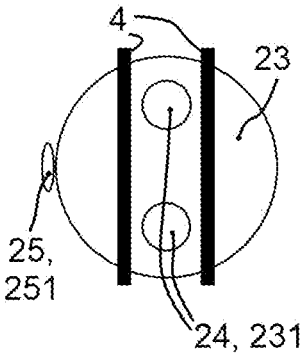
FIG. 20 shows a schematic illustration of a potential assembly position of two retaining rings.
Figure 21:
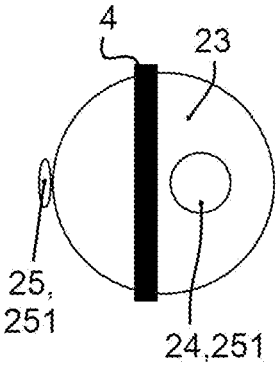
FIG. 21 shows a schematic illustration of a potential assembly position of a retaining ring.

Advantageous positions of the valves 24, 25, or the inlet/outlet 251, 241 in relation to the cover 23 are illustrated in FIGS. 19 to 21. In this way, it can be provided, for example, that the fluid inlet 251, or the inlet valve 24, are disposed outside the center of the cover 23 so as to achieve space for the retaining ring 4. A reed valve, optionally with a detent, can be considered for the valve 24, 25, for example.

Advantageous adaptations can be performed in particular in terms of the ring width or ring height, the ring material (tubular material, welded, extruded, . . . ), the cover material (sintered material, forged material, . . . ). One or a plurality of retaining rings 4 per radial piston pump can be used, as is illustrated in FIG. 20, for example, retaining rings 4 and 4*a*. The retaining rings in this case are preferably disposed axially behind one another. It can preferably be provided that the retaining ring 4 has an assembly bevel on the internal side, for simplifying assembling.

The radial piston pump proposed herein can preferably be used as an air conditioning compressor, preferably having an electric motor as a drive. Accordingly, the fluid is preferably a refrigerant.

What is claimed is:

1. A radial piston pump, comprising:

a drive shaft;

at least first and second piston-and-working chamber combinations received in a pump main body; and a retaining ring;

wherein each piston-and-working chamber combination includes a working chamber and a piston;

wherein each piston-and-working chamber combination extends radially relative to a longitudinal axis of the drive shaft;

wherein each working chamber is enclosed by a cover;

wherein the retaining ring fixes all of the covers of the radial piston pump;

wherein the covers and/or the pump main body have/has a resting rim for the retaining ring.

2. The radial piston pump of claim 1, further comprising a third piston-and-working chamber combination, wherein the first, second, and third piston-and-working chamber combinations are disposed in a star-shaped manner about the drive shaft.

3. The radial piston pump of claim 1, wherein each cover has a contact face for the retaining ring.

4. The radial piston pump of claim 1, wherein the radial piston pump has at least two retaining rings for fixing all of the covers of the radial piston pump, and wherein the retaining rings are disposed axially behind one another with respect to the longitudinal axis.

5. The radial piston pump of claim 1, wherein an interference fit is provided between the retaining ring and each cover.

6. The radial piston pump of claim 1, wherein the retaining ring has an internal diameter according to tolerance class IT7 or IT8.

7. The radial piston pump of claim 1, further comprising a housing configured to receive at least in portions the pump main body and each of the piston-and-working chamber combinations.

8. The radial piston pump of claim 7, wherein the housing of the radial piston pump is configured from at least two housing components, including a high-pressure housing, and/or a stator housing for receiving a rotor and a stator of an electric motor.

9. The radial piston pump of claim 8, wherein the retaining ring is integrated in the housing or at least one housing component.

10. The radial piston pump of claim 8, wherein the housing components are screwed to one another.

11. The radial piston pump of claim 8, wherein the pump main body includes a flange which serves for screw-fitting to the housing and/or housing components.

12. The radial piston pump of claim 8, wherein the housing components configure fluid ducts of the radial piston pump.

13. The radial piston pump of claim 8, wherein the housing components include plane-parallel axial sealing faces.

14. The radial piston pump of claim 13, wherein seals are disposed between the sealing faces.

15. The radial piston pump of claim 13, wherein surfaces of the sealing faces have one or a plurality of geometric shapes which deviate from planar.

16. The radial piston pump of claim 8, wherein fluctuations in a mutual spacing of the housing components can be compensated for by an elasticity.

17. A method for producing the radial piston pump of claim 1, wherein the fixing of the retaining ring is performed by a thermal-shrinkage transverse interference fit between the covers and the retaining ring, comprising:

heating the retaining ring prior to assembly;

joining the retaining ring to the covers; and cooling the retaining ring.

18. A method for producing the radial piston pump of claim 1, wherein fixing of the retaining ring is performed by a longitudinal interference fit between the covers and the retaining ring, comprising:

pushing the retaining ring onto the covers with an overlap; and elastically expanding the retaining ring.

19. A method for producing the radial piston pump of claim 1, wherein fixing of the retaining ring is performed by a welded connection, comprising:

slitting the retaining ring so as to generate a slit;

joining the retaining ring to the covers;

tensioning the retaining ring, preferably by means of a tool (W); and closing the slit.

20. A method for producing the radial piston pump of claim 1, wherein the covers are configured to be elastically resilient and/or to elastically yield to provide gaps in a region of contact faces of the covers, wherein the covers, prior to joining the retaining ring, by a device/tool are elastically pressed radially inward to provide the gaps for the retaining ring for a duration of a joining procedure.

21. The radial piston pump of claim 1, wherein the resting rim has a radially extending face as a detent for the retaining ring.

22. The radial piston pump of claim 1, wherein, when the retaining ring bears against the resting rim, the covers are retained in their angular position relative to the pump main body.

23. The radial piston pump of claim 1, wherein, when the retaining ring bears against the resting rim, an axial position of the retaining ring on the pump main body is maintained.

* * * * *